US007600393B2

(12) United States Patent
Kim

(10) Patent No.: US 7,600,393 B2
(45) Date of Patent: Oct. 13, 2009

(54) REFRIGERANT DISTRIBUTING DEVICE FOR MULTI-TYPE AIR CONDITIONER

(75) Inventor: Chan Gu Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 262 days.

(21) Appl. No.: 11/369,000

(22) Filed: Mar. 7, 2006

(65) Prior Publication Data

US 2006/0201197 A1 Sep. 14, 2006

(30) Foreign Application Priority Data

Mar. 9, 2005 (KR) ..... 10-2005-0019799
Mar. 9, 2005 (KR) ..... 10-2005-0019801

(51) Int. Cl.
*F25B 39/02* (2006.01)

(52) U.S. Cl. ..... 62/504; 62/525

(58) Field of Classification Search ..... 62/504, 62/498, 467

See application file for complete search history.

(56) References Cited

FOREIGN PATENT DOCUMENTS

| | | | |
|---|---|---|---|
| EP | 1 122 503 | | 8/2001 |
| EP | 1 707 902 | A2 | 10/2006 |
| JP | 03 263563 | A | 11/1991 |
| JP | 03263563 | A * | 11/1991 |
| JP | 06 317364 | A | 11/1994 |
| JP | 08 029018 | A | 2/1996 |
| JP | 11 063734 | A | 3/1999 |
| JP | 2000-111205 | | 4/2000 |
| JP | 2000-320929 | | 11/2000 |
| JP | 2000320929 | A * | 11/2000 |

OTHER PUBLICATIONS

English Translation Of JP2000320929A.*

* cited by examiner

*Primary Examiner*—Melvin Jones
(74) *Attorney, Agent, or Firm*—McKenna Long & Aldridge LLP

(57) ABSTRACT

Disclosed herein is a refrigerant distributing device for a multi-type air conditioner, which can discharge an evenly mixed refrigerant to a plurality of indoor units. The refrigerant distributing device comprises an inlet pipe to supply a refrigerant, a distributor, and a plurality of outlet pipes. The distributor comprises an inlet port connected with the inlet pipe, a mix zone having a predetermined space formed therein such that the refrigerant induced through the inlet port forms a vortex flow within the mix zone so as to be evenly mixed, and a plurality of outlet ports separably connected with the mix zone to discharge the refrigerant having passed through the mix zone to an outside. The plurality of outlet pipes selectively connects at least one outlet ports of the distributor and each outlet pipe, for adjusting the amount of refrigerant supplied to each outlet pipe based on the capacity of each indoor unit connected with each outlet pipe.

23 Claims, 9 Drawing Sheets

REFRIGERANT DISTRIBUTING DEVICE FOR MULTI-TYPE AIR CONDITIONER

This application claims the benefit of Korean Patent Application Nos. 10-2005-0019799 and 10-2005-0019801 filed on Mar. 9, 2005, which are hereby incorporated by references as if fully set forth herein.

BACKGROUND OF THE INVENTION

1. Field of the Invention

The present invention relates to a refrigerant distributing device for a multi-type air conditioner, and more particularly, to a refrigerant distributing device for a multi-type air conditioner, which distributes a refrigerant supplied from an outdoor unit to a plurality of indoor units.

2. Discussion of the Related Art

An air conditioner is installed in a room to heat or cool or purify indoor air, thereby providing a fresh indoor environment.

Generally, the air conditioner comprises compressor, condenser, expansion valve, evaporator, and the like, which are connected by a refrigerant pipe along which the refrigerant flows when the air conditioner is operated.

Recently, a multi-type air conditioner comprising a plurality of indoor units operated by a single outdoor unit has been increasingly used.

In the conventional multi-type air conditioner, the refrigerant discharged from one or more compressors is gathered into a single refrigerant pipe, divided and then distributed into the respective indoor units by a refrigerant distributor.

FIGS. 1 and 2 show the structure of a refrigerant distributing device of the conventional multi-type air conditioner.

In FIG. 1, a conventional refrigerant distributing device comprises an inlet pipe 2 connected to an outdoor unit to supply a refrigerant, a distributor 1 to distribute the refrigerant induced through the inlet pipe 2, and a plurality of outlet pipes 3 to guide the refrigerant distributed by the distributor 1 to a plurality of indoor units.

Referring to FIG. 2, the distributor 1 comprises a single inlet port 1*a*, and a plurality of outlet ports 1*b*. The inlet port 1*a* is connected with the inlet pipe 2 (see FIG. 1), and the outlet ports 1*b* are connected with the outlet pipes 3 (see FIG. 1).

The distributor 1 has a plurality of flow paths 1*c* branched therein to allow the refrigerant induced through the inlet port 1*a* to be distributed to the respective outlet ports 1*b*. Thus, when the refrigerant is supplied to the inlet port 1*a* through the inlet pipe 2, the refrigerant is divided by the respective flow paths 1*c* within the distributor 1, and is distributed to the respective outlet ports 1*b*. Then, the refrigerant is supplied to the respective indoor units through the outlet pipes 3.

However, such a conventional refrigerant distributing device has problems as follows.

First, the refrigerant flowing into the distributor 1 through the inlet pipe 2 comprises a liquid refrigerant and a gaseous refrigerant. In the refrigerant, the gaseous refrigerant having a low specific gravity tends to flow through an upper flow path of the flow paths in the distributor 1, while the liquid refrigerant tends to flow through a lower flow path within the distributor 1.

As a result, the refrigerant is unevenly distributed through the respective flow paths 1*c* of the distributor 1, causing uneven heat exchanging efficiency of the indoor units.

Second, the conventional refrigerant distributing device cannot adjust an amount of refrigerant supplied through the respective outlet pipes. As a result, the conventional refrigerant distributing device has a problem in that the amount of refrigerant cannot be suitably distributed according to cooling capacity of the indoor units located in respective rooms.

SUMMARY OF THE INVENTION

Accordingly, the present invention is directed to a refrigerant distributing device for a multi-type air conditioner that substantially obviates one or more problems due to limitations and disadvantages of the related art.

An object of the present invention is to provide a refrigerant distributing device for a multi-type air conditioner, which can discharge an evenly mixed refrigerant irrespective of an installation position of indoor units or a state of the refrigerant.

It is another object of the present invention to provide the refrigerant distributing device for the multi-type air conditioner, which can supply the refrigerant after uniformly mixing the refrigerant, an amount of which is suitably adjusted according to cooling capacity of indoor units installed in respective rooms.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerant distributing device for a multi-type air conditioner, comprising: an inlet pipe to supply a refrigerant; a distributor comprising an inlet port connected with the inlet pipe and a plurality of outlet ports branched with a plurality of flow paths from the inlet port to discharge the refrigerant having been drawn to an outside; a plurality of outlet pipes to separately guide the refrigerant discharged from the distributor to a plurality of indoor units; and a plurality of connecting pipes to selectively connect at least one outlet ports of the distributor and each outlet pipe, for adjusting the amount of refrigerant supplied to each outlet pipe based on the capacity of each indoor unit connected with each outlet pipe.

In accordance with another aspect of the present invention, a refrigerant distributing device for a multi-type air conditioner comprises: an inlet pipe to supply a refrigerant; a distributor comprising an inlet port connected with the inlet pipe, a mix zone having a predetermined space formed therein such that the refrigerant induced through the inlet port forms a vortex flow within the mix zone so as to be evenly mixed, and a plurality of outlet ports separably connected with the mix zone to discharge the refrigerant having passed through the mix zone to an outside; and a plurality of outlet pipes to separately guide the refrigerant discharged through the outlet ports of the distributor to a plurality of indoor units.

In accordance with another aspect of the present invention, a refrigerant distributing device for a multi-type air conditioner comprises: an inlet pipe to supply a refrigerant; a distributor comprising an inlet port connected with the inlet pipe, a mix zone having a plurality of grooves formed in a spiral shape on an inner surface thereof such that the refrigerant induced through the inlet port forms a vortex flow so as to be evenly mixed within the mix zone, and a plurality of outlet ports in a spiral shape in an axial direction from inner ends connected with the grooves to the outlets thereof and separatably connected with the respective grooves of the mix zone to divide and discharge the refrigerant having passed through the mix zone to an outside;

a plurality of outlet pipes to separately guide the refrigerant discharged through the outlet ports of the distributor to a plurality of indoor units; and a plurality of connecting pipes to selectively connect the respective outlet pipes with at least one outlet port of the distributor.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
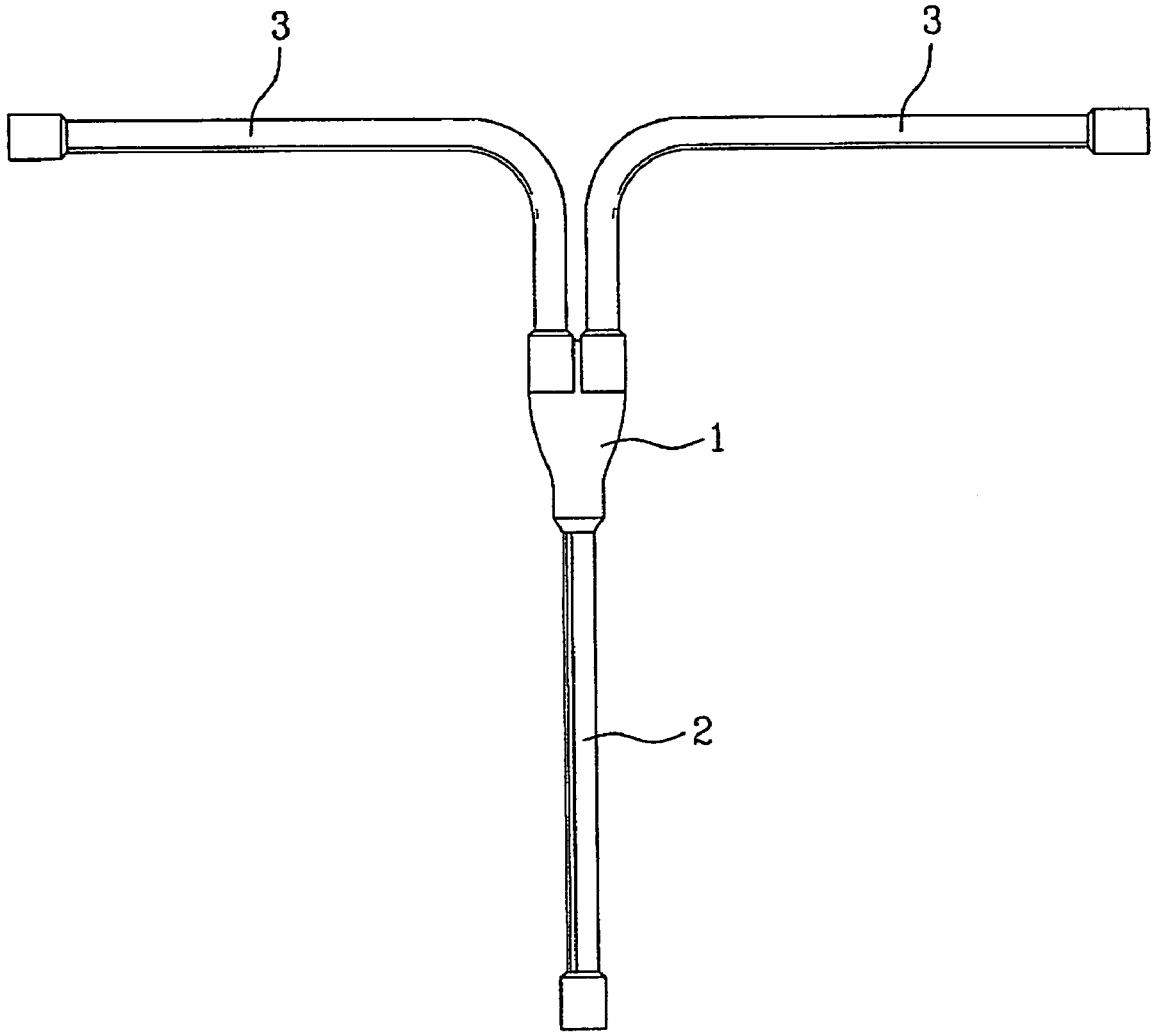
FIG. 1 is a view illustrating the structure of a conventional refrigerant distributing device for an air conditioner.
Figure 2:
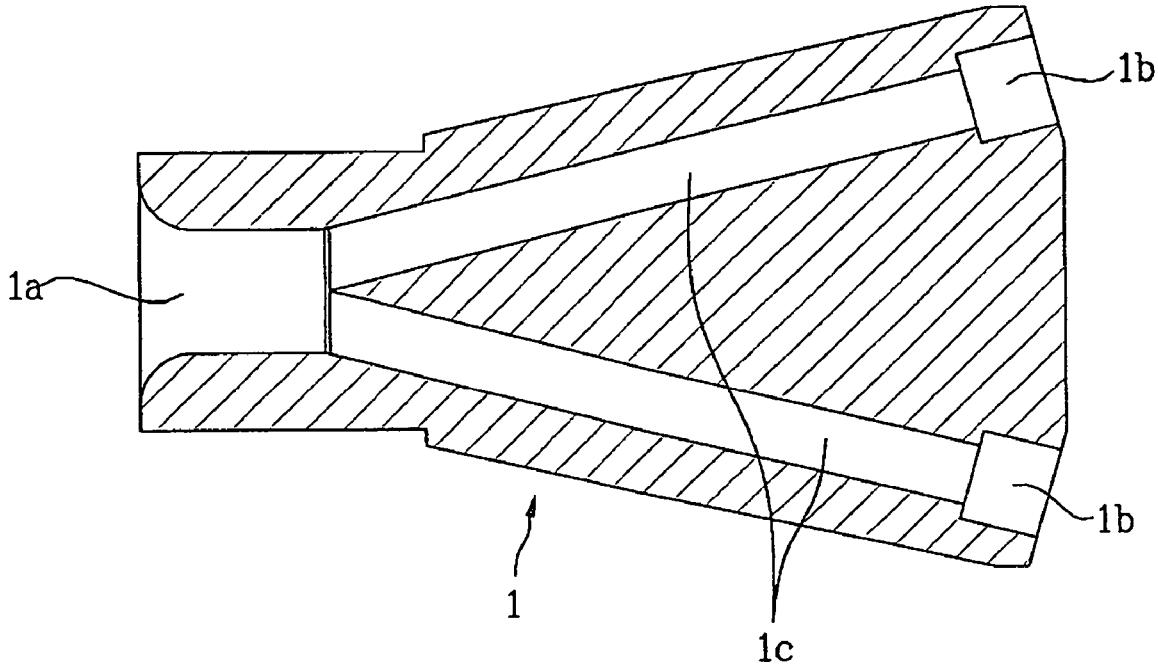
FIG. 2 is a cross-sectional view illustrating an inner structure of the refrigerant distributing device shown in FIG. 1.
Figure 3:
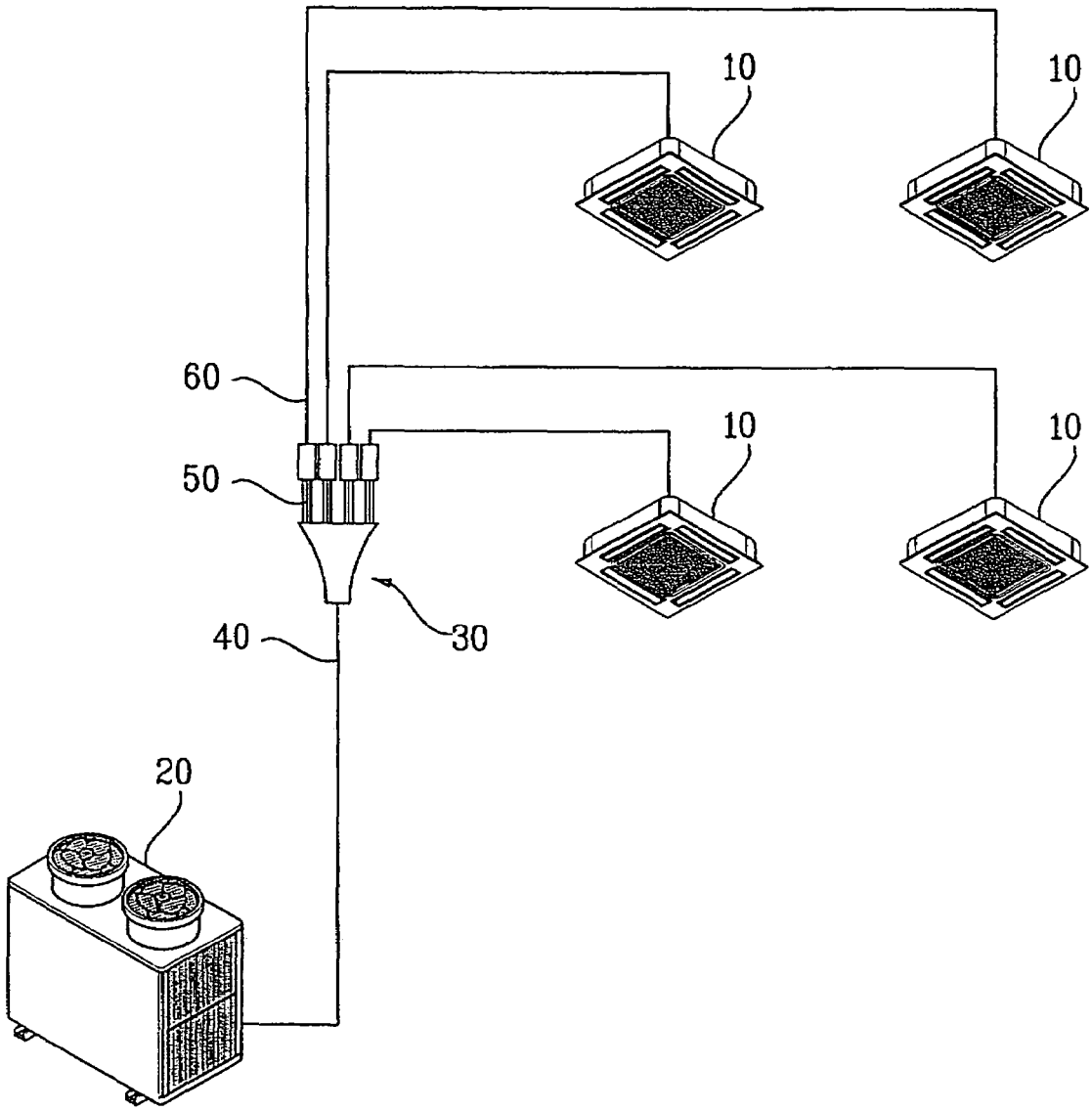
FIG. 3 is a perspective view illustrating the construction of a multi-type air conditioner in accordance with the present invention.
Figure 4:
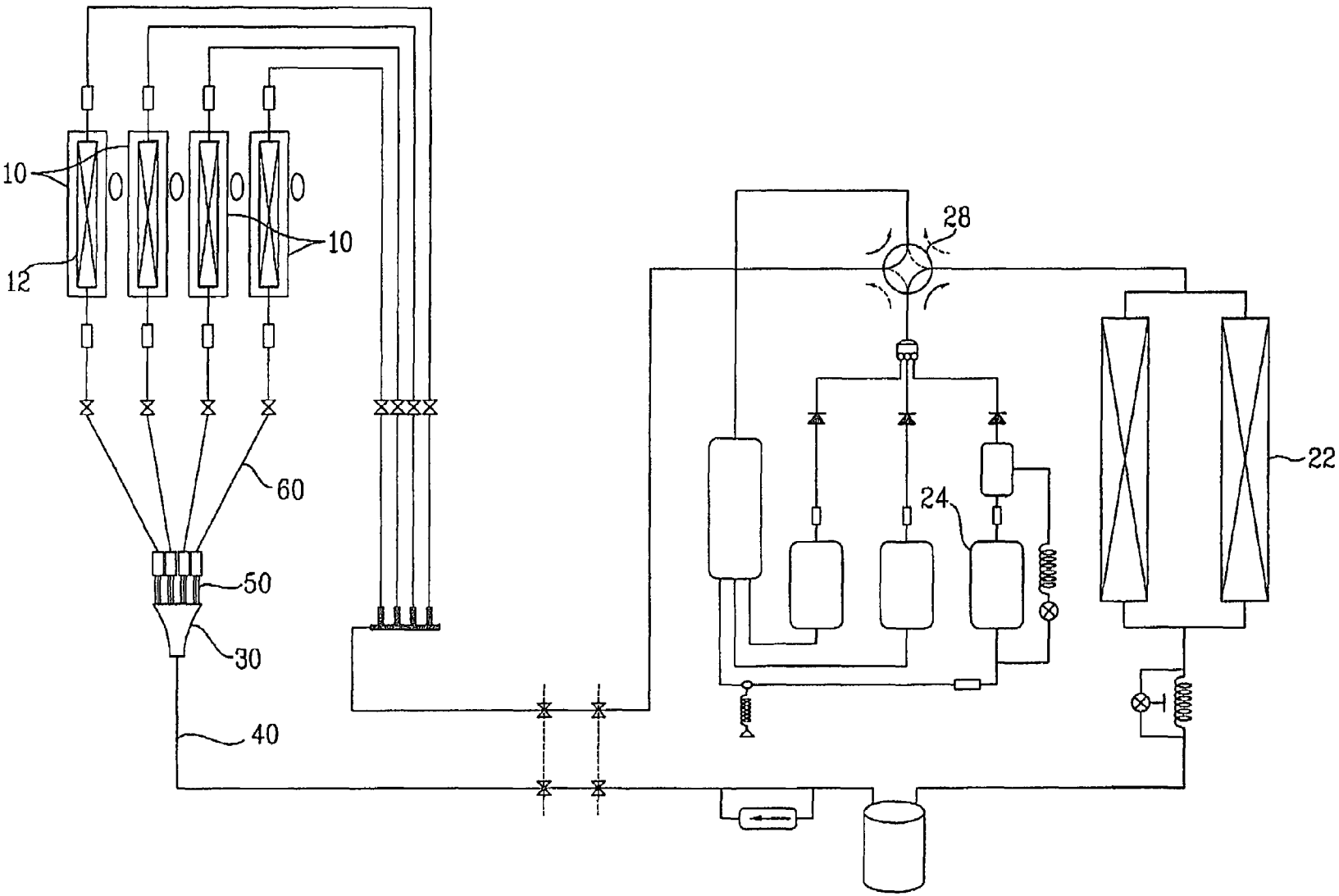
FIG. 4 is a constructional view illustrating the multi-type air conditioner in accordance with the present invention.
Figure 5:
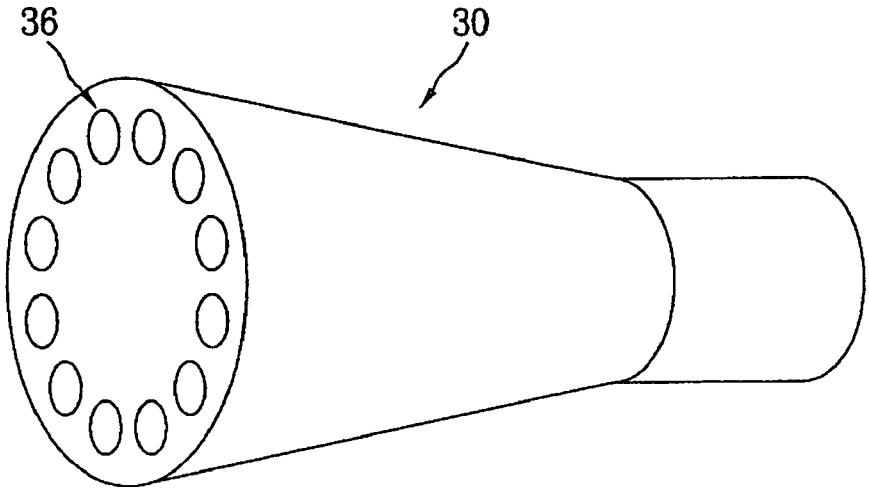
FIG. 5 is a perspective view illustrating one embodiment of a distributor of the refrigerant distributing device in accordance with the present invention.
Figure 6:
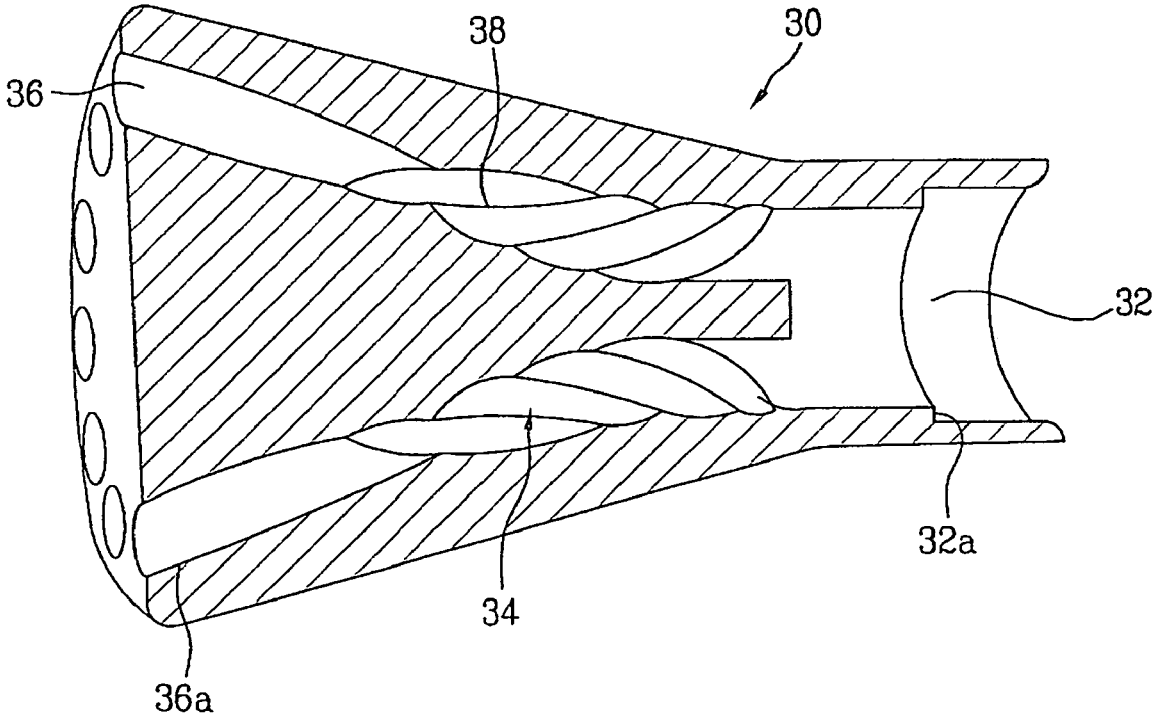
FIG. 6 is a cross-sectional view illustrating the distributor shown in FIG. 5.
Figure 7:
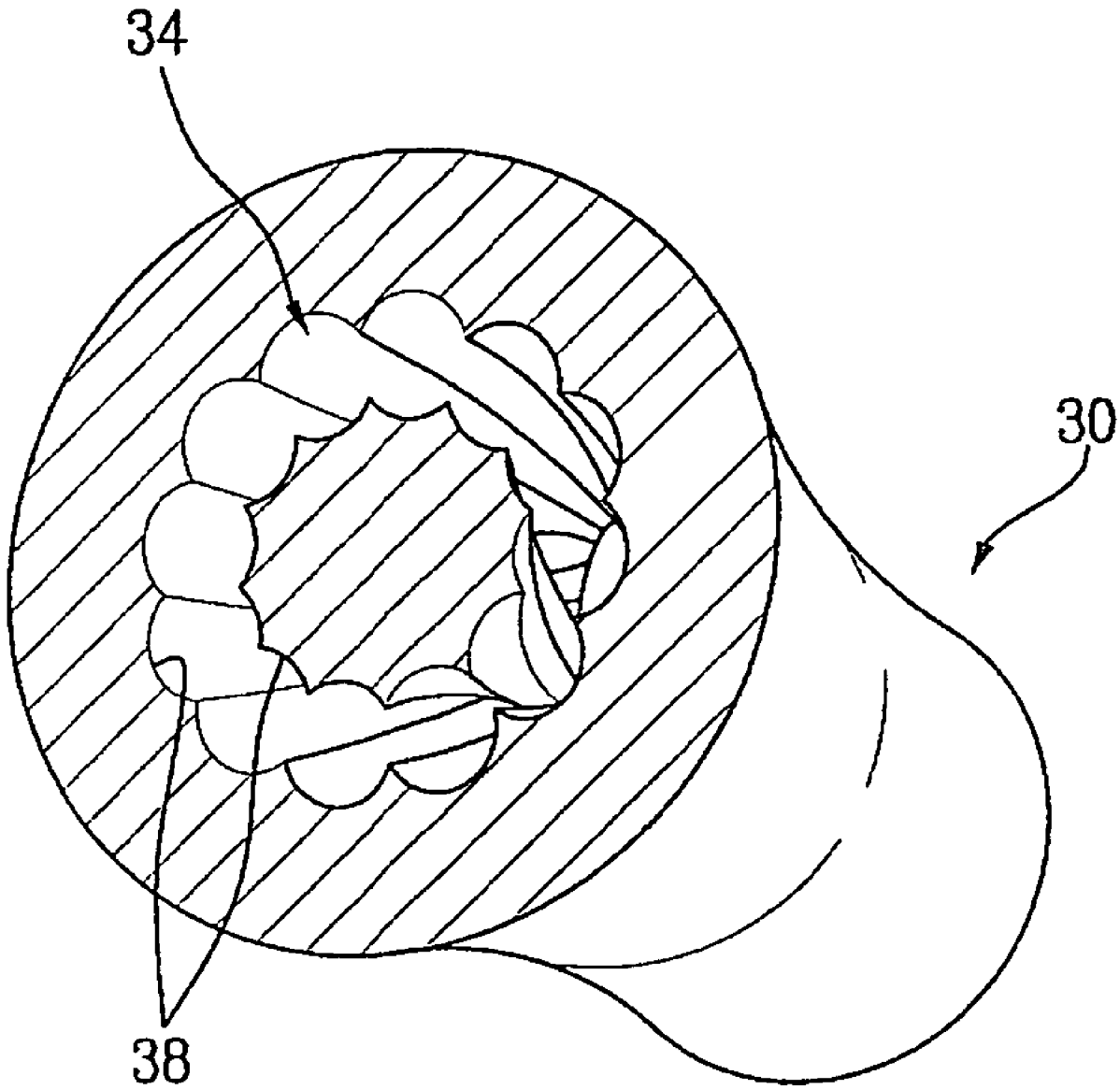
FIG. 7 is a cross-sectional view illustrating the shape of a mix zone of the distributor shown in FIG. 5.

First, as shown in FIGS. 3 and 4, a multi-type air conditioner according to the present invention comprises multiple indoor units 10, and an outdoor unit 20. The indoor units 10 are installed in respective rooms, and the outdoor unit 20 is connected with the indoor units 10 via refrigerant pipes and a distributor 30.

Each of the indoor units 10 comprises an indoor heat exchanger 12 by which heat exchange is performed between indoor air and a refrigerant.

The outdoor unit 20 comprises an outdoor heat exchanger 22 by which heat exchange is performed between outdoor air and the refrigerant, a compressor 24 to compress and supply the refrigerant, and a four-way valve 28 to selectively supply the refrigerant compressed by the compressor 24 to the indoor heat exchangers 12 or the outdoor heat exchanger 22.

Operation of the multi-type air conditioner will be described hereinafter.

First, after being compressed by the compressor 24, the refrigerant passes through the four-way valve 28. At this time, a controller (not shown) of the multi-type air conditioner controls the four-way valve 28 according to an operation mode of the air conditioner to force the refrigerant to flow towards the outdoor heat exchanger 22 or towards the indoor heat exchangers 12.

For example, when the multi-type air conditioner is operated in a cooling mode, the four-way valve 28 allows the refrigerant to be supplied to the outdoor heat exchanger 22 such that the outdoor heat exchanger 22 can be operated as a condenser. On the other hand, when the multi-type air conditioner is operated in a heating mode, the four-way valve 28 allows the refrigerant to be supplied to the indoor heat exchangers 12 such that the indoor heat exchangers 12 can be operated as the condenser.

When the multi-type air conditioner is operated in the cooling mode, the refrigerant supplied to the outdoor heat exchanger 22 through the compressor 24 condenses via condensation. Then, the condensed refrigerant expands via an expansion valve (not shown), and is supplied to each indoor heat exchanger 12 installed in each room. After being supplied to the indoor heat exchanger 12, the refrigerant evaporates while being heat-exchanged with indoor air, thereby cooling the room.

On the other hand, when the multi-type air conditioner is operated in the heating mode, the refrigerant supplied to each indoor heat exchanger 12 through the compressor 24 condenses via heat exchange with indoor air. During condensation of the refrigerant, the refrigerant emits heat into the room, thereby heating the room.

Meanwhile, as described above, it is necessary for the multi-type air conditioner to suitably distribute the refrigerant supplied from the single outdoor unit to the plural indoor units 10. The distributor 30 performs the function of distributing the refrigerant. After receiving the refrigerant supplied through an inlet pipe 40 connected with the outdoor unit 20, the distributor 30 evenly mixes the refrigerant, and appropriately distributes the mixed refrigerant to outlet pipes 60 connected with the respective indoor units 10.

The structure and operation of the distributor 30 will be described in detail with reference to FIGS. 5 to 8 hereinafter.

The inlet pipe 40 is connected with an inlet of the distributor 30, and the plural outlet pipes 60, 62 and 64 are connected with an outlet of the distributor 30. The outlet pipes 60, 62 and 64 are connected with the distributor 30 by a plurality of connecting pipes 50.

The distributor 30 has a substantially cone shape. The distributor 30 has a single flow path formed at the inlet connected with the inlet pipe 40, and a plurality of flow paths formed at the outlet connected with the connecting pipes 50.

More specifically, the distributor 30 comprises an inlet port 32 formed at a portion thereof with which the inlet pipe 40 is connected, a mix zone 34 to uniformly mix the refrigerant having flown through the inlet port 32, and a plurality of outlet ports 36 to divide the refrigerant having passed through the mix zone 34.

The mix zone 34 has a plurality of grooves 38 formed in a spiral shape on an inner surface thereof such that the refrigerant induced through the inlet port 32 flows in a spiral shape in the mix zone 34. Here, the respective spiral grooves 38 are communicated with each other, and have outlet ports which are correspondingly in communication with inner ends of the respective outlet ports 36.

In other words, each of the spiral grooves 38 forms a continuous flow path along with each of the outlet ports 36. Here, the outlet ports of the spiral grooves 38 are divided from each other at portions connected with the respective outlet ports 36.

As such, the mix zone 34 is a space to uniformly mix the refrigerant induced through the inlet port 32, and is formed as the flow paths constituting the respective outlet ports 36 are communicated with each other.

In addition, the flow paths of the outlet ports 36 branched from the outlet of the mix zone preferably have a spiral shape with respect to a central axis of the distributor 30.

Accordingly, the spiral flow paths are formed from the inlet of the mix zone 34 to the respective outlet ports 36. Here, preferably, there is a phase difference of about 90 degrees between an inlet of each groove 38 of the mix zone 34 and an outlet of each outlet port 36 corresponding to each groove 38.

A mixing process of a refrigerant within the distributor 30 will be described as follows.

First, when the refrigerant flows into the inlet ports 32, the refrigerant is rotated by the grooves 38 in the mix zone 34, and forms a vortex flow. At this time, since the respective grooves 38 are communicated with each other within the mix zone 34, the refrigerant in each groove 38 is mixed with the refrigerant flowing through adjacent grooves 38 while flowing in a spiral shape.

Accordingly, when the refrigerant mixture of a gaseous refrigerant and a liquid refrigerant is supplied to the distributor 30, the distributor 30 allows the gaseous refrigerant and the liquid refrigerant to be evenly mixed via the vortex flow formed by the grooves 38 therein while preventing the refrigerant of a specific property from being biased to one side therein.

After being evenly mixed through the mix zone 34, the refrigerant is divided into the flow paths of the respective outlet pipes 60 at the outlet of the mix zone 34, and then discharged to the outlet pipes 60 through the outlets of the respective outlet ports 36.

Meanwhile, the inlet port 32 is formed with a stopper 32*a* which blocks the inlet pipe 40 inserted thereto.

In addition, distal ends of the plural outflow ports 36 are circumferentially arranged at a constant interval, and each of the outlet ports 32 is formed with a stopper 36*a* which blocks each of the connecting pipes 50 inserted thereto.

The connecting pipes 50 are connected with the respective outlet ports 36 to guide the evenly mixed refrigerant towards the outlet pipes 60, 62 and 64. Here, the connecting pipes 50 are connected with the outlet pipes 60, 62 and 64 in several bundles.

The present invention can adjust an amount of refrigerant distributed to the respective outlet pipes 60, 62 and 64 through the distributor 30 according to connection relationship between the connecting pipes 50 and the outlet pipes 60, 62 and 64.

Figure 8:
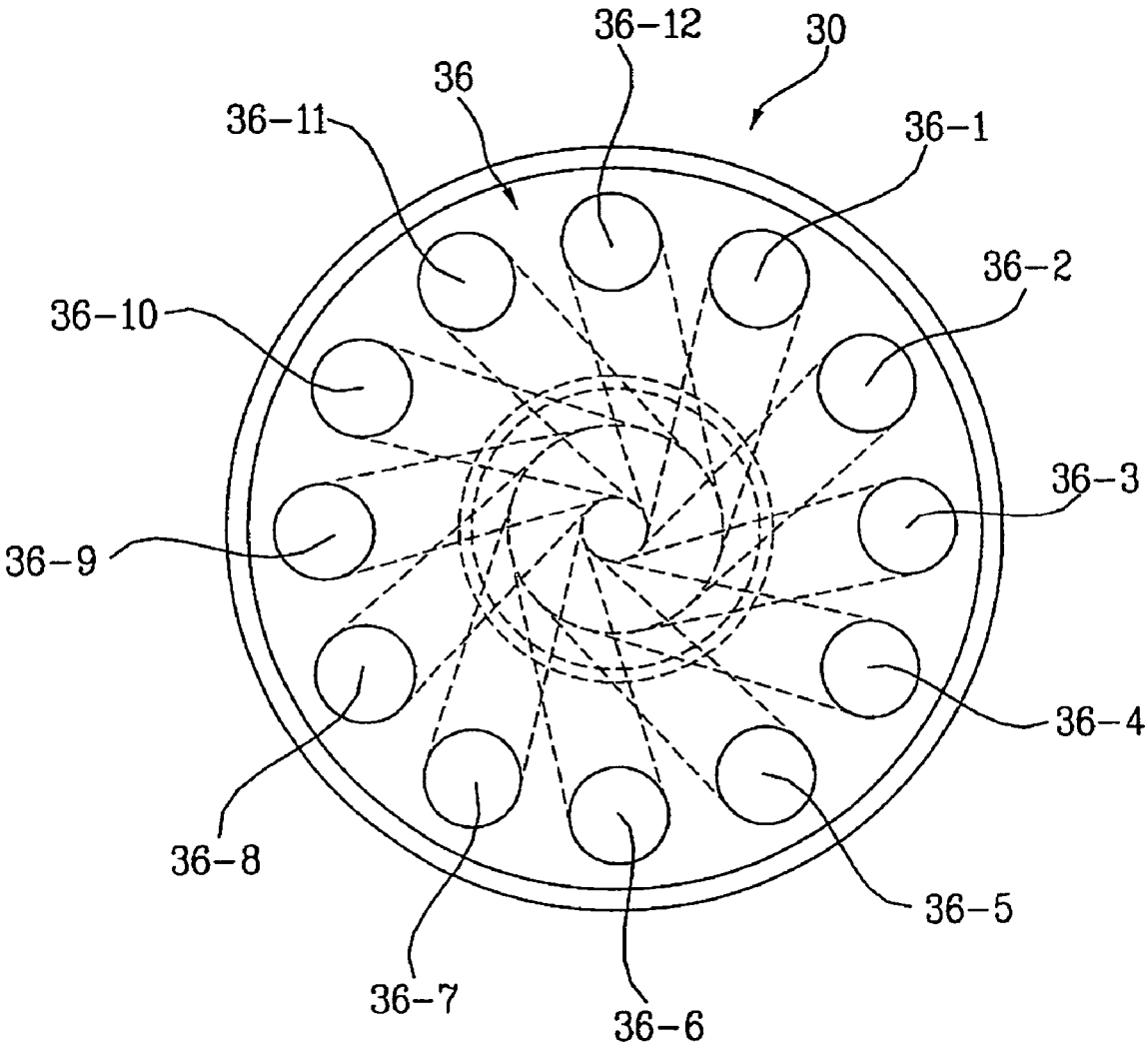
FIG. 8 is a view illustrating the distributor shown in FIG. 5 in which the distributor is shown at a side of outlet ports.
Figure 9:
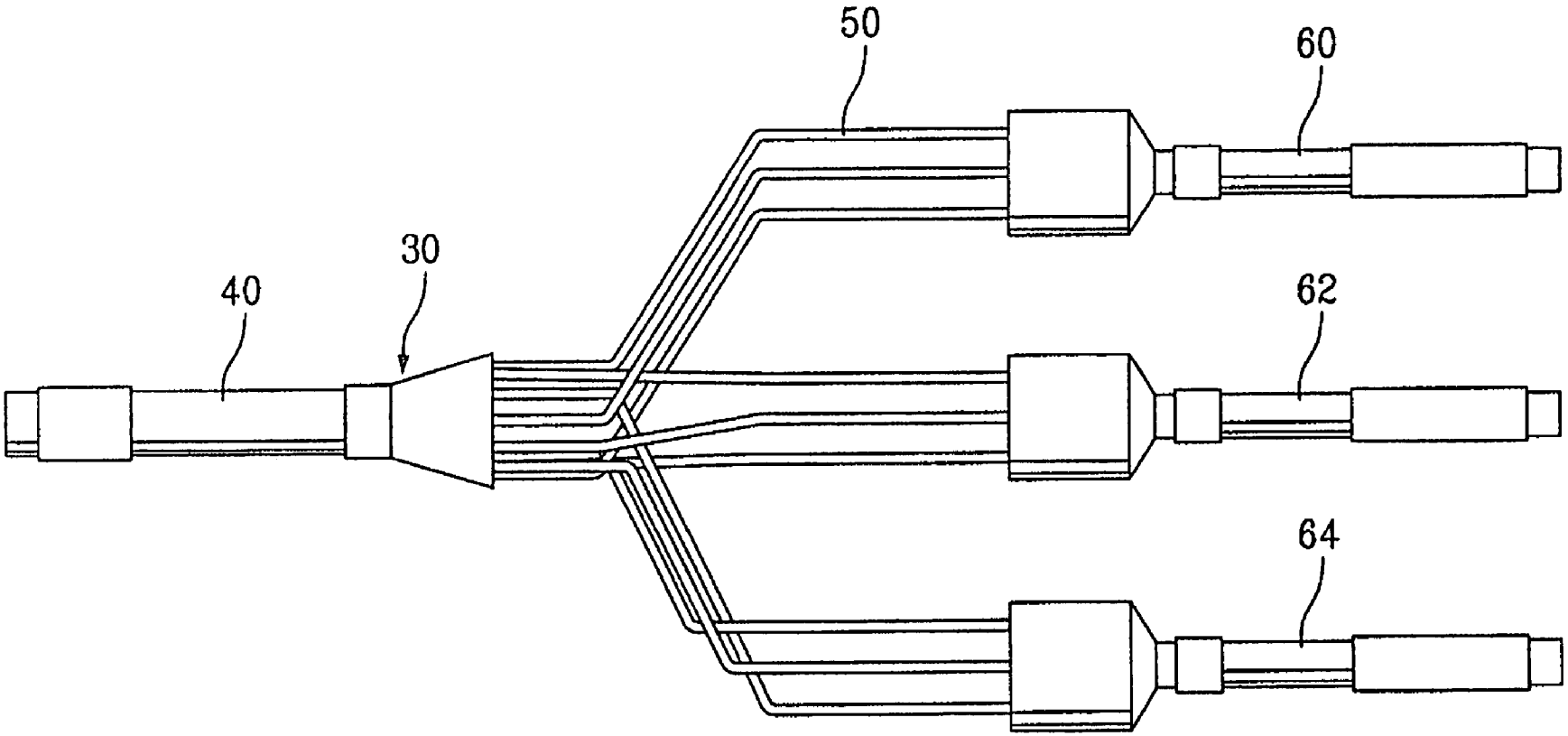
FIG. 9 is a view illustrating one example of a branch structure of the refrigerant distributing device for the multi-type air conditioner in accordance with the present invention.

For example, as shown in FIGS. 8 and 9, when the number of outlet ports 36 is twelve, and the number of outlet pipes 60, 62 and 64 connected with the indoor heat exchangers 12 is three, four connecting pipes 50 are connected with each of the outlet pipes 60, 62 and 64 as a single bundle.

In this case, preferably, among outlet ports shown in FIG. 8 (here, twelve outlet ports are referred as first to twelfth outlet ports in the clockwise direction, and are indicated by reference numerals 36-1 to 36-12 for convenience of understanding), a first outlet pipe 60 is connected with the connecting pipes 50 which are connected with first, fourth, seventh and tenth outlet ports 36-1, 36-4, 36-7 and 36-10, respectively, and a second outlet pipe 62 is connected with the connecting pipes 50 which are connected with second, fifth, eighth and eleventh outlet ports 36-2, 36-5, 36-8 and 36-11, respectively. In addition, a third outlet pipe 64 is connected with the connecting pipes 50 which are connected with third, sixth, ninth and twelfth outlet ports 36-3, 36-6, 36-9 and 36-12, respectively. With the outlet pipes connected with the connecting pipes in this order, the refrigerant can be evenly distributed from the respective outlet ports arranged in a circular shape.

Figure 10:
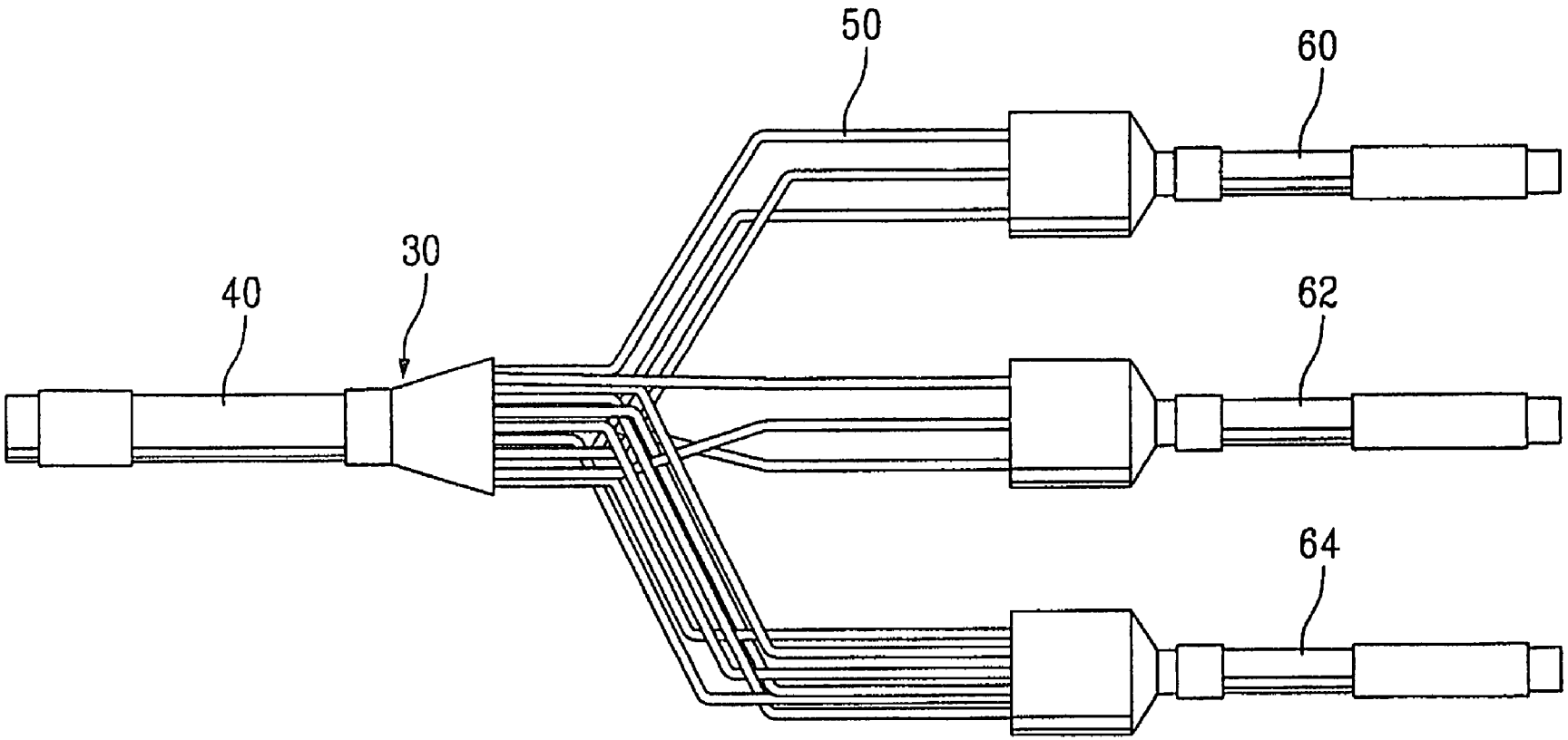
FIG. 10 is a view illustrating another example of a branch structure of the refrigerant distributing device for the multi-type air conditioner in accordance with the present invention.

In addition, as shown in FIGS. 8 and 10, when the number of outlet pipes 60, 62 and 64 is three, and it is desired to distribute an amount of refrigerant at a ratio of 1:1:2 through the respective outlet pipes 60, 62 and 64, three connecting pipes 50 are connected with the respective outlet pipes 60 and 62, and other connecting pipes 50 are connected with the remaining outlet pipe 64, thereby constituting uneven branches.

In this case, the first outlet pipe 60 is connected with the connecting pipes 50 which are connected with the first, fifth and ninth outlet ports 36-1, 36-5 and 36-9, respectively, and the second outlet pipe 62 is connected with the connecting pipes 50 which are connected with the second, sixth and tenth outlet ports 36-2, 36-6 and 36-10, respectively. The third outlet pipe 64 is connected with the connecting pipes 50 which are connected with the third, forth, seventh, eighth, eleventh and twelfth outlet ports 36-3, 36-4, 36-7, 36-8, 36-11 and 36-12, respectively.

As apparent from the above description, one of the advantageous effects of the present invention is that, when the refrigerant flows into the mix zone through the inlet port of the distributor, the mix zone causes the refrigerant to flow in vortex, so that the refrigerant is distributed to the respective outlet ports after being evenly mixed in the mix zone, thereby preventing efficiency of heat-exchange from being lowered due to uneven distribution of the refrigerant into the respective indoor units.

Accordingly, the refrigerant distributing device for the multi-type air conditioner according to the present invention has another advantageous effect in that the refrigerant distributing device can not only supply the refrigerant which is evenly mixed depending on the number of indoor units installed in the respective rooms, but also supply the refrigerant, an amount of which is suitably adjusted according to different capacities of the indoor units.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerant distributing device for a multi-type air conditioner, comprising:

an inlet pipe to supply a refrigerant;

a distributor comprising an inlet port connected with the inlet pipe and a plurality of outlet ports branched with a plurality of flow paths from the inlet port to discharge the refrigerant having been drawn to an outside and a mix zone formed therein having a plurality of grooves formed in a spiral shape on an inner surface of the distributor;

a plurality of outlet pipes to separately guide the refrigerant discharged from the distributor to a plurality of indoor units; and a plurality of connecting pipes to selectively connect at least one outlet ports of the distributor and each outlet pipe, for adjusting the amount of refrigerant supplied to each outlet pipe based on the capacity of each indoor unit connected with each outlet pipe, wherein the grooves are communicated with each other, and each groove has an outlet which is divided from each other at a portion correspondingly connected with an inner end of each outlet port.

2. The refrigerant distributing device according to claim 1, wherein the respective outlet pipes are connected with the same number of connecting pipes.

3. The refrigerant distributing device according to claim 1, wherein the respective outlet pipes are connected with different numbers of connecting pipes.

4. The refrigerant distributing device according to claim 1, wherein the connecting pipes are alternately connected with the respective outlet ports of the distributor.

5. The refrigerant distributing device according to claim 1, wherein the mix zone is formed within an inner surface of the distributor for uniformly mixing and the refrigerant having flown through the inlet port by forming vortex flow in the refrigerant and dividing the refrigerant to each outlet port.

6. The refrigerant distributing device according to claim 5, wherein the plurality of grooves is formed in a flowing direction.

7. The refrigerant distributing device according to claim 1, wherein an inlet of each groove and an outlet of each outlet port are formed with a phase difference of about 90 degrees therebetween.

8. The refrigerant distributing device according to claim 1, wherein the outlet ports are formed in a spiral shape in an axial direction from the inner ends connected with the grooves to outlets thereof.

9. The refrigerant distributing device according to claim 1, wherein the distributor has a conical shape.

10. The refrigerant distributing device according to claim 1, wherein the outlet ports are arranged in a circumferential direction on one end of the distributor.

11. The refrigerant distributing device according to claim 1, wherein the outlet ports form a spiral flow path in an axial direction from inner ends connected with the mix zone to outlets thereof.

12. A refrigerant distributing device for a multi-type air conditioner, comprising:

an inlet pipe to supply a refrigerant;

a distributor comprising:

an inlet port connected with the inlet pipe, a mix zone having a predetermined space formed therein such that the refrigerant induced through the inlet port forms a vortex flow within the mix zone so as to be evenly mixed, the mix zone formed therein having a plurality of grooves formed in a spiral shape on an inner surface of the distributor; and a plurality of outlet ports separably connected with the mix zone to discharge the refrigerant having passed through the mix zone to an outside; and a plurality of outlet pipes to separately guide the refrigerant discharged through the outlet ports of the distributor to a plurality of indoor units, wherein the grooves are communicated with each other, and each groove has an outlet which is divided from each other at a portion correspondingly connected with an inner end of each outlet port.

13. The refrigerant distributing device according to claim 12, further comprising: a plurality of connecting pipes to selectively connect the respective outlet pipes with at least one outlet port of the distributor.

14. The refrigerant distributing device according to claim 13, wherein the respective outlet pipes are connected with the same number of connecting pipes.

15. The refrigerant distributing device according to claim 13, wherein the respective outlet pipes are connected with different numbers of connecting pipes.

16. The refrigerant distributing device according to claim 13, wherein the connecting pipes are alternately connected with the respective outlet ports of the distributor.

17. The refrigerant distributing device according to claim 12, wherein the plurality of grooves formed in a flowing direction.

18. The refrigerant distributing device according to claim 12, wherein an inlet of each groove and an outlet of each outlet port are formed with a phase difference of about 90 degrees therebetween.

19. The refrigerant distributing device according to claim 12, wherein the outlet ports are formed in a spiral shape in an axial direction from the inner ends connected with the grooves to outlets thereof.

20. The refrigerant distributing device according to claim 12, wherein the distributor has a conical shape.

21. The refrigerant distributing device according to claim 12, wherein the outlet ports are arranged in a circumferential direction on one end of the distributor.

22. The refrigerant distributing device according to claim 12, wherein the outlet ports form a spiral flow path in an axial direction from inner ends connected with the mix zone to outlets thereof.

23. A refrigerant distributing device for a multi-type air conditioner comprising:

an inlet pipe to supply a refrigerant;

a distributor comprising an inlet port connected with the inlet pipe, a mix zone having a plurality of grooves formed in a spiral shape on an inner surface thereof such that the refrigerant induced through the inlet port forms a vortex flow so as to be evenly mixed within the mix zone, the mix zone formed therein having a plurality of grooves formed in a spiral shape on an inner surface of the distributor; and a plurality of outlet ports in a spiral shape in an axial direction from inner ends connected with the grooves to the outlets thereof and separably connected with the respective grooves of the mix zone to divide and discharge the refrigerant having passed through the mix zone to an outside;

a plurality of outlet pipes to separately guide the refrigerant discharged through the outlet ports of the distributor to a plurality of indoor units; and a plurality of connecting pipes to selectively connect the respective outlet pipes with at least one outlet port of the distributor, wherein the grooves are communicated with each other, and each groove has an outlet which is divided from each other at a portion correspondingly connected with an inner end of each outlet port.

* * * * *